US005712667A

United States Patent [19]

Sato

[11] Patent Number: 5,712,667

[45] Date of Patent: Jan. 27, 1998

[54] MEANS FOR AND METHOD OF DETECTING THE STATE OF INK REMAIN IN A CARTRIDGE HAVING CONTAINING PORTIONS DIFFERING IN INK CONTAINING STATE

[75] Inventor: Osamu Sato, Kawasaki, Japan

[73] Assignee: Canon Kabushiki Kaisha, Tokyo, Japan

[21] Appl. No.: 292,014

[22] Filed: Aug. 18, 1994

[30] Foreign Application Priority Data

Aug. 25, 1993 [JP] Japan ..... 5-210552

[51] Int. Cl.[6] ..... B41J 2/19; B41J 2/175

[52] U.S. Cl. ..... 347/7; 347/87

[58] Field of Search ..... 347/86, 87, 7

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,383,263 | 5/1983 | Ozawa et al. | 347/86 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,631,556 | 12/1986 | Watanabe et al. | 346/140 R |
| 4,723,129 | 2/1988 | Endo et al. | 346/1.1 |
| 4,740,796 | 4/1988 | Endo et al. | 346/1.1 |
| 5,068,806 | 11/1991 | Gatten | 395/113 |
| 5,070,346 | 12/1991 | Mochizuki et al. | 347/7 |
| 5,414,452 | 5/1995 | Accatino | 347/7 |

FOREIGN PATENT DOCUMENTS

| | | | |
|---|---|---|---|
| 0443245A3 | 8/1991 | European Pat. Off. | B41J 2/175 |
| 0593282A2 | 4/1994 | European Pat. Off. | B41J 2/175 |
| 54-056847 | 5/1979 | Japan . | |
| 54-133373 | 10/1979 | Japan . | |
| 57-51474 | 3/1982 | Japan | B41J 3/04 |
| 59-123670 | 7/1984 | Japan . | |
| 59-138461 | 8/1984 | Japan . | |
| 59-194853 | 11/1984 | Japan . | |
| 60-31021 | 2/1985 | Japan | G01F 23/28 |
| 60-071260 | 4/1985 | Japan . | |
| 60-56561 | 4/1985 | Japan | B41J 3/04 |
| 62-209317 | 9/1987 | Japan | G01F 23/28 |
| 1017465 | 3/1989 | Japan . | |
| 01120352 | 5/1989 | Japan | 347/7 |
| 92018335 | 10/1992 | WIPO | 347/7 |

*Primary Examiner*—Valerie A. Lund

*Attorney, Agent, or Firm*—Fitzpatrick, Cella, Harper & Scinto

[57] ABSTRACT

The present invention has as its object to detect the termination of ink reliably and highly accurately in an ink jet recording apparatus. An ink cartridge 2 has an opening 5 for connection to a recording head 1, and is comprised of a negative pressure generating member containing portion 14 containing a negative pressure generating member 13 and having an atmosphere communicating port 10, and an ink containing portion 16 which is adjacent to the negative pressure generating member containing portion 14 and communicates therewith at the bottom 11 of the ink cartridge. Ink detecting means 3 is provided below the ink containing portion 16. When the detecting means 3 detects a reduction in the remain in the ink containing portion 16, ink remains only in the negative pressure generating member containing portion 14 and the remainder can be substantially estimated. For the remaining ink, the amount of use is calculated by the counting of discharge pulses or the like and is compared, whereby the remain of the ink can be detected accurately and easily.

32 Claims, 7 Drawing Sheets

MEANS FOR AND METHOD OF DETECTING THE STATE OF INK REMAIN IN A CARTRIDGE HAVING CONTAINING PORTIONS DIFFERING IN INK CONTAINING STATE

BACKGROUND OF THE INVENTION

1. Field of the Invention

This invention relates to an ink termination detecting device for detecting ink termination in the ink storing container or the like of an ink jet recording apparatus for discharging ink to thereby effect recording, or a remain state detecting device for detecting the remain state of ink. Particularly, this invention relates to an ink remain state detecting device for and a method of detecting the remain state of ink contained in an ink storing container comprising a plurality of containing members capable of containing ink which communicate in different states.

2. Related Background Art

In a so-called ink jet recording apparatus, ink is discharged from a recording head to thereby effect recording on a recording medium such as recording paper.

An ink storing device such as an ink tank for storing therein ink to be supplied to the recording head is mounted on a predetermined fixed region of the ink jet recording apparatus, or is carried on a carriage with the recording head. In the former case, an ink supply path such as an ink tube is provided between the recording head and the storing device, and this is designed to follow the movement of the carriage.

In the latter case, the ink supply path provided between the recording head and the storing device can be made relatively short. Therefore, the construction in which the ink storing device is carried on the carriage can be said to be a construction suitable for downsizing or simplifying the ink jet recording apparatus.

Among such constructions in which the recording head and the ink storing device (ink tank) are both carried on the carriage, there are a construction in which the recording head and the ink tank are formed integrally with each other and a construction in which the recording head and the ink tank are separably carried. In the construction wherein the recording head and the ink tank are formed integrally with each other, a cartridge comprising the ink tank and the recording head made integral with each other is interchanged with a new one at a point of time whereat the ink in the ink tank has become exhausted and therefore, this construction is easy to handle and thus has been spreading in recent years, but the expensive head is interchanged each time the ink becomes exhausted and this leads to the rise of running cost.

Also, in the construction wherein the recording head and the ink tank are separably carried, the ink tank alone can be interchanged when the ink becomes exhausted, and the head itself can also be interchanged at the end of its life. In ordinary use, generally it is impossible that the head becomes unusable due to its life before the ink in the ink tank is used up. Therefore, the ink tank alone is interchanged when the ink becomes exhausted and thus, running cost can be suppressed. However, it is necessary to make the connecting portion between the ink tank and the recording head elaborately so that the ink may not leak.

In any of the various ink jet recording apparatuses as described above, it is desirable to provide a construction for accurately knowing the amount of ink remaining in the ink storing means, in order to effect the interchange of the ink storing means at an appropriate time.

When the ink in the ink storing means becomes exhausted during recording, the discharge means of the recording head continues to create energy for discharge in the absence of the ink. Particularly, in an ink jet recording apparatus of the recently known thermal jet type in which heat energy is imparted to ink by heat energy generating means and the pressure by a change in the state of the ink is utilized to discharge the ink, a heater for discharge as the heat energy generating means is driven in the absence of the ink and therefore, not only the temperature of the recording head rises but also the recording head itself is damaged. Accordingly, the aforedescribed construction for knowing the remain state of ink can be said to be indispensable.

In recent years, there has come to be known a technique of making the volume of ink which can be contained in the ink storing means large to thereby reduce the frequency of interchange of the ink storing means. By such a technique, not only running cost can be reduced, but also the frequency of the manipulation cumbersome to the user can be decreased.

A technique of making the volume of ink in ink storing means large is proposed in U.S. Application Ser. No. 08/094, 313. According to this application, use is made of an ink storing container in which a negative pressure generating member containing portion and an ink containing portion for containing ink are separated, whereby substantially all of ink except ink adhering to the wall surface in the ink containing portion can be used and the large volume of the ink contained in the ink storing container is achieved. Also, the leakage of the ink from a recording head can be prevented by the negative pressure generating member contained in the ink storing container and a stable ink supplying performance can be maintained for a long period.

Ink termination detecting devices for detecting the termination of ink in the ink storing container or the like of an ink jet recording apparatus include one using an optical element as disclosed in Japanese Laid-Open Patent Application No. 54-133373, one which detects by the conduction of an electrode member as disclosed in Japanese Patent Publication No. 1-17465, one which counts discharge pulse number as disclosed in Japanese Laid-Open Patent Application No. 59-194853, etc..

However, it has been difficult for the above-mentioned ink termination detecting devices (ink remain state detecting devices) according to the prior art to accurately detect the remain state of ink in the aforedescribed ink storing container wherein the negative pressure generating member containing portion and the ink containing portion are separated.

For example, among the above-mentioned devices according to the prior art, it has been difficult due to the structure of the ink storing container for one using an optical element and one which detects by the conduction of an electrode member to detect the exhaustion of the ink in the negative pressure generating member containing portion, and even if the remain state of the ink only in the ink containing portion is detected, ink may still remain in the negative pressure generating member containing portion, and this device could only be applied to the warning of the fact that the ink has decreased to some extent. Also, it has become difficult with the larger volume of ink for the device which counts discharge pulse number to detect the remain of ink accurately. Further, an attempt to effect the detection accurately has led to very high costs, and the amount of ink used differs depending on the irregularity of the initial amount of supply and the environment of use, and this has led to a problem that accurate detection cannot be accomplished.

SUMMARY OF THE INVENTION

The present invention has been made in view of the above-noted problems and an object thereof is to accurately detect the remain state of ink in an ink cartridge having a plurality of ink containing chambers differing in the ink containing state from each other and communicated with each other by a gap portion.

Another object of the present invention is to enable the above-described ink cartridge to be used until immediately before ink becomes exhausted.

To achieve the above objects, the ink jet recording apparatus of the present invention is provided with an ink jet head for discharging ink, and an ink cartridge for supplying the ink to said ink jet head, said ink cartridge having a first ink containing chamber containing a negative pressure generating member and provided with a communicating portion for supplying the ink to said ink jet head, and a second ink containing chamber directly containing the ink to be supplied to said first ink containing chamber, and is characterized by first detecting means for detecting the remain state of the ink in said second ink containing chamber, ink used amount calculating means for calculating the amount of ink used from said ink cartridge, and control means for starting the calculation by said ink used amount calculating means when said first detecting means detects that the remain of the ink in said second ink containing chamber has become smaller than a predetermined amount.

Also, the present invention is an ink remain state detecting method in an ink jet recording apparatus provided with an ink jet head for discharging ink, and an ink cartridge for supplying the ink to said ink jet head, said ink cartridge having a first ink containing chamber containing a negative pressure generating member and provided with a communicating portion for supplying the ink to said ink jet head, and a second ink containing chamber directly containing the ink to be supplied to said first ink containing chamber, and is characterized by the detecting step of detecting the remain state of the ink in said second ink containing chamber, and the used ink amount calculating step of calculating the amount of ink used from said ink cartridge when it is detected by said detecting step that the remain of the ink in said second ink containing chamber has become smaller than a predetermined amount.

BRIEF DESCRIPTION OF THE PREFERRED EMBODIMENTS

Some embodiments of the present invention will hereinafter be described in detail with reference to the drawings.

(First Embodiment)

Figure 1:
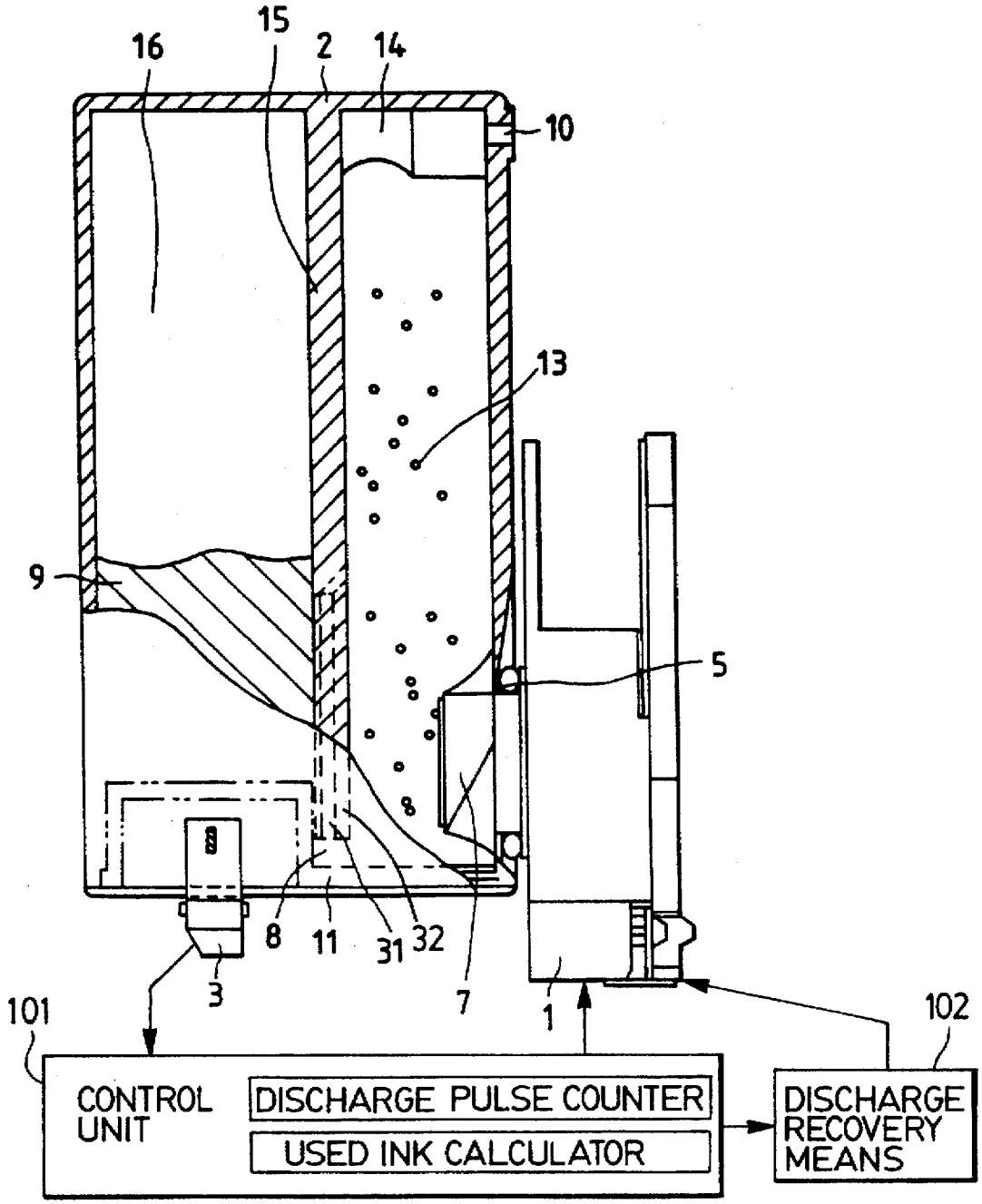
FIG. 1 shows a state in which an ink jet recording head and an interchangeable type ink cartridge used in the present invention and ink detecting means are fitted together.

FIG. 1 is a cross-sectional view of an ink storing container as an embodiment of the present invention having a negative pressure generating member containing portion and an ink containing portion as it is seen from a side thereof, and the ink storing container is designed such that the remain state of ink therein can be accurately detected. A sponge-like porous material is suitably used as the negative pressure generating member.

Figure 2:
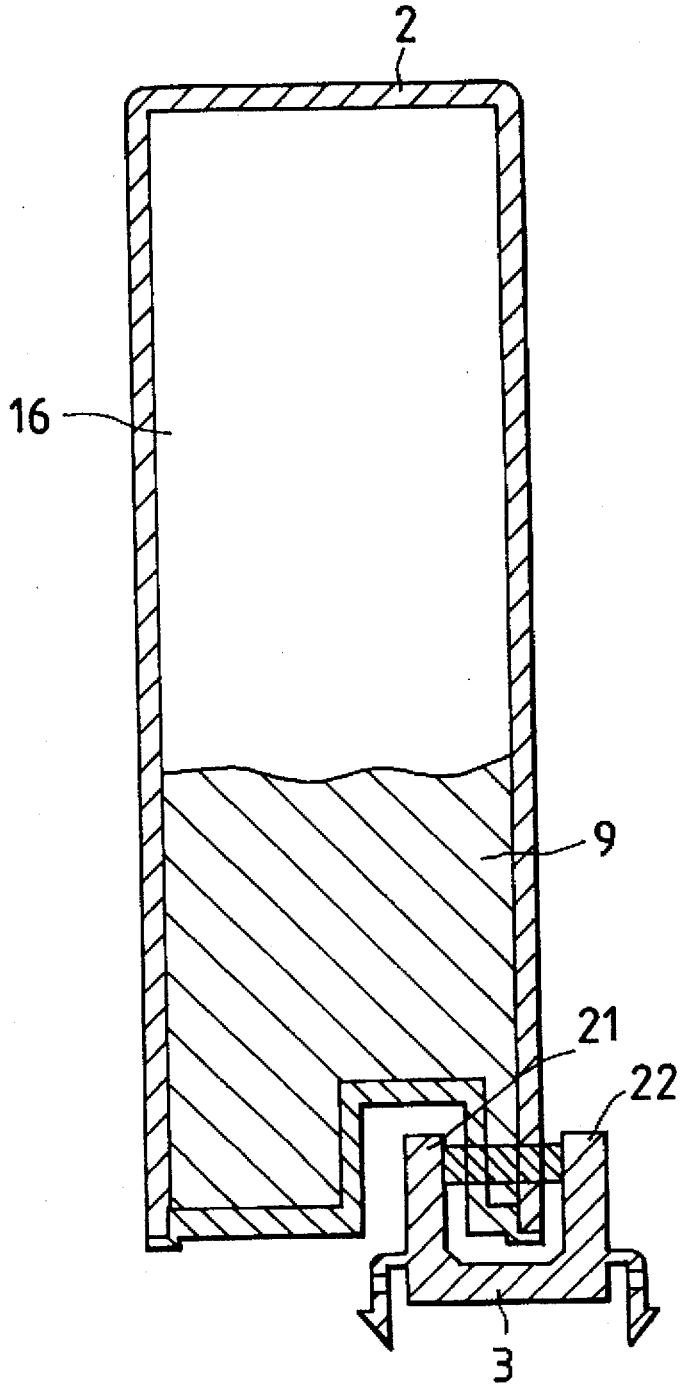
FIG. 2 shows the positional relationship between an interchangeable type ink cartridge according to a first embodiment of the present invention and the ink detecting means.

FIG. 2 shows the positional relationship between an ink cartridge 2 and ink detecting means 3 in FIG. 1.

Figure 3:
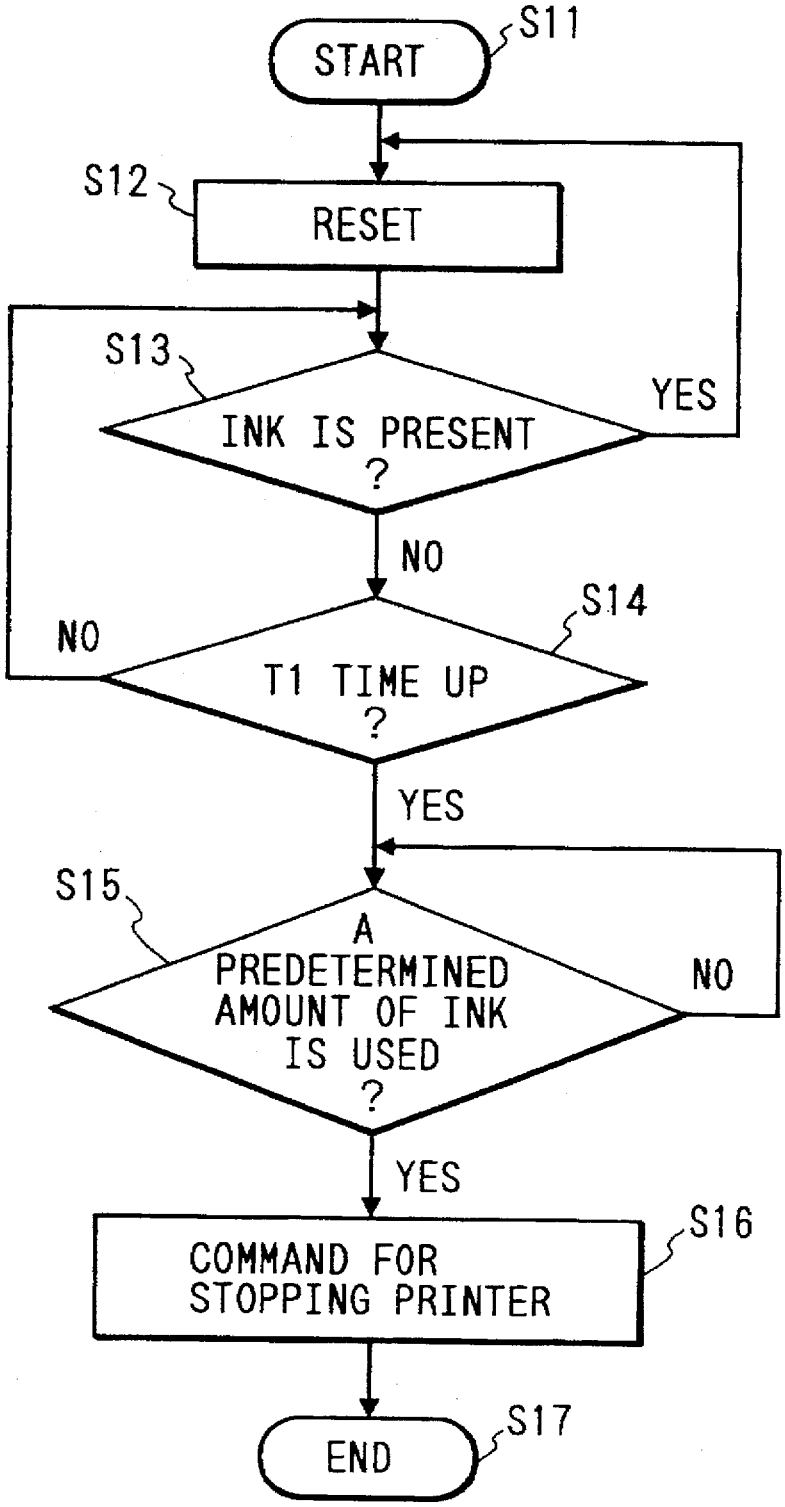
FIGS. 3 to 5 and FIG. 7 are flow charts showing the detection of the remain state of ink in the embodiment.

FIG. 3 is a flow chart showing the operation of an ink remain state detecting device.

In FIG. 2, the interchangeable type ink cartridge 2 and an ink jet recording head 1 for discharging ink by the ink jet system to thereby effect recording are separably constructed.

In FIG. 1, a joint member 7 for supplying the ink to the recording head 1 is inserted in the ink cartridge 2 and is urged against a negative pressure generating member 13 and the ink jet recording apparatus is in its operable state.

The interchangeable type ink cartridge 2 has a gap portion 5 for connection to the ink jet recording head 1, and is comprised of a negative pressure generating member containing portion 14 containing a negative pressure generating member 13 (specifically, a porous material such as sponge) and having an atmosphere communicating port 10, and an ink containing portion 16 containing ink 9 which is adjacent to the negative pressure generating member containing portion 14 with a partition wall 15 interposed therebetween and communicates with the negative pressure generating member containing portion 14 at the bottom 11 of the ink cartridge. A filter may desirably be installed on the end portion of the joint member 7 to eliminate dust in the ink cartridge 2.

When the ink jet recording apparatus is operated, the ink is discharged from the nozzle of the ink jet recording head 1, whereby an ink sucking force is created to the ink cartridge 2 and the ink in the negative pressure generating member 13 is consumed.

The operation of the ink jet recording apparatus is controlled by a control unit 101 which performs various functions such as counting the number of ink discharge pulses, calculating the amount of used ink, effecting recovery processing, and detecting whether the remaining amount of ink is less than a predetermined amount, as described in more detail below.

As regards the ink cartridge 2, an atmosphere introducing groove 31 and a negative pressure generating member regulating chamber 32 are formed in portions of the partition wall 15 between the ink containing portion 16 and the negative pressure generating member containing portion 14. The atmosphere introducing groove 31 is formed in the negative pressure generating member containing portion 14 side from the intermediate portion of the partition wall 15 to the end portion of the partition wall 15, i.e., the gap portion 8 with the bottom 11 of the ink cartridge. The negative pressure generating member regulating chamber 32 of a scraped-out shape is formed between the partition wall 15 and the negative pressure generating member 13 in contact with the vicinity of the atmosphere introducing groove 31 of the partition wall 15.

When the ink in the negative pressure generating member containing portion 14 is consumed, the interface between the atmosphere and liquid (air-liquid interface) in the negative pressure generating member containing portion 14 lowers and the atmosphere is introduced into the ink containing portion 16 and thus, the ink is supplied into the negative pressure generating member containing portion 14. So-called air-liquid exchange takes place.

The negative pressure in the negative pressure generating member containing portion 14 is regulated by the meniscus position on the aforementioned air-liquid interface and the supply of the ink can be done without the ink leaking from the recording head.

The negative pressure generating member 13 is brought into contact with the inner surface of the negative pressure generating member containing portion 14 and therefore, even if for example, the negative pressure generating member 13 is non-uniformly inserted, the contact (compression) force of the negative pressure generating member 13 will be partially alleviated. Therefore, when the ink begins to be consumed from the recording head, the ink impregnating the negative pressure generating member 13 is consumed and reaches the negative pressure generating member regulating chamber 32. When the ink continues to be consumed still thereafter, the atmosphere becomes ready to break the ink meniscus from the portion in which the contact force of the negative pressure generating member 13 is alleviated by the negative pressure generating member regulating chamber 32, and the atmosphere is rapidly introduced into the atmosphere introducing groove 31 and thus, the control of the negative pressure becomes easy.

The partition wall 15 and negative pressure generating member regulating chamber 32, including other construction functionally equal to these, are generically referred to as air-liquid exchange expediting structure. In an ink cartridge having this air-liquid exchange expediting structure, the optimum ink liquid level area can be obtained by regulating the height of the top of the air-liquid exchange expediting structure disposed on the side wall surface of the negative pressure generating member containing chamber 14 above the communicating portion between the negative pressure generating member containing portion 14 and the ink containing portion 16.

As means for controlling the optimum ink liquid level area, there is a method of changing the direction of compression and the rate of compression of the negative pressure generating member as previously described, but the regulation of the top position of the air-liquid exchange expediting structure can achieve the purpose more reliably and with better reproducibility. Of course, by combining these methods, the ink liquid level may be rendered into the above-described optimum area.

Substantially all of the ink except the ink adhering to the wall surface in the ink containing portion 16 is used by the ink cartridge 2 of the construction as described above.

FIG. 2 is a schematic view showing the structure for detecting a state in which the ink remain in the ink containing portion 16 of the ink cartridge 2 has been reduced.

At the bottom of the ink cartridge 2, a light emitting element 21 and a light receiving element 22 as ink detecting means 3 in the ink containing portion 16 are disposed in opposed relationship with each other relative to the transparent ink containing portion 16. When the ink containing portion 16 is filled with the ink 9, the optical path is intercepted by the ink 9, more accurately, by the dye or pigment in the ink 9, and the output of the light receiving element 22 is not put out, but when the ink 9 decreases, the output of the light receiving element 22 is put out, whereby the decrease in the remain of the ink in the ink containing portion is detected, and preferably, the termination of the ink is detected when the ink in the ink containing portion 16 has become exhausted.

The whole of the ink containing portion 16 need not be transparent, but only the portion thereof through which light is transmitted by the light emitting element 21 and light receiving element 22 may be formed by a transparent member.

FIG. 3 is a flow chart showing the process of detection of the remain state of the ink in the first embodiment.

In the construction of the ink cartridge shown in FIG. 1, as previously described, the ink is supplied from the ink containing portion 16 by the air-liquid exchange each time the ink in the negative pressure generating member containing portion 14 is consumed to a certain degree. Thus, at a point of time whereat the ink in the ink containing portion 16 has been almost consumed, a certain degree of ink remains in the negative pressure generating member containing portion 14. In the present embodiment, the decrease in the ink is detected until a point of time at which the remain of the ink in the ink containing portion 16 has become substantially null, and continuedly the detection of the remain state is effected for the ink remaining in the negative pressure generating member containing portion 14, and detecting methods suitable for the different ink containing portions 14 and 16 are applied.

In FIG. 3, the initial setting operation is first performed at a step S12. Here, it is to be understood that the resetting of a timer T1 which will be described later is effected. Subsequently, at a step S13, whether it has been detected that the ink has decreased below a predetermined amount is judged.

If at the step S13, it is detected from the detection level that the ink remain has become null, whether the timer T1 has been time up is judged at the next step S14, and when a reduction in the ink remain is detected at a point of time whereat the timer T1 has been time up, it is judged that the ink remain has actually been reduced. This is because when the ink is consumed and its remain reaches the vicinity of the detection level, the ink sways in the ink containing portion 16 due to the movement of the carriage on which the ink cartridge is mounted and the output of the light receiving element 22 repeats ON and OFF, and thus, the time when the sway of the ink ceases is set by the timer T1 and accurate detection of the remain is effected.

When the ink in the ink containing portion 16 has become exhausted, the amount of ink remaining in the negative pressure generating member containing portion 14 can be substantially estimated and therefore, at the next step S15, whether a predetermined amount of ink has been used is judged, and recording is effected until immediately before the ink in the ink cartridge becomes exhausted.

As recorded amount detecting means for detecting a value conforming to a recorded amount in case of recording, the discharge pulse number is counted and it is multiplied by the predetermined discharge amount of the ink jet recording head 1 per pulse, for example, 80 to 90 ng in the case of monochrome of 360 dpi, to thereby calculate the amount of used ink, and this amount of used ink is compared with the set value of a record amount printable with the ink preset in the negative pressure generating member containing portion 14 (for example, the amount of usable ink such as 20 g), and when the amount of used ink becomes equal to the set value of the record amount, the printing by the ink jet recording apparatus is finally stopped. The record amount printable with the ink in the negative pressure generating member containing portion 14 differs depending on the volume of the negative pressure generating member containing portion 14, but generally it is 10 to 20 sheets, and in the case of an interchangeable type ink cartridge of a predetermined volume, irregularity is very small and accurate detection of the remain state of the ink is possible, and the ink cartridge can be used until immediately before the ink becomes exhausted.

Here, the discharge amount per pulse is fixed as the value of 80 to 90 ng, but by the discharge amount per pulse being corrected by the cumulative value of the discharge pulse number during the detection of the termination of the ink and the foreseen amount of used ink till the detection of the preset termination of the ink, more accurate detection of the termination of the ink is possible.

Also, the amount of ink consumed in a recovery process such as sucking and preliminary discharge carried out at the start of recording and during recording is added to the aforedescribed amount of used ink obtained by counting the pulses to detect the remain state, whereby more accurate detection can be effected.

By the above-described construction, the detection of the remain state of the ink can be accurately effected in an ink cartridge having a plurality of containing portions differing in the ink containing state, such as an ink containing portion and a negative pressure generating member containing portion, and the ink cartridge can be used until immediately before the ink becomes exhausted.

(Second Embodiment)

In the ink jet recording apparatus, when for example, printing has not been effected for a long period in order to prevent the non-discharge of ink, recovery processes from clogging are effected. During that process, about 0.1 g of ink is consumed per process. So, in the present embodiment, a value obtained by multiplying the number of recovery processes from clogging by a present amount of ink used per recovery process is added to the calculation in the detection of the remain state of the ink in the negative pressure generating member containing portion 14 after the exhaustion of the ink in the ink containing portion 16 by the aforedescribed first embodiment. Thereby, more accurate detection becomes possible because the estimated value by the calculation is based on the real amount of use.

(Third Embodiment)

In the aforedescribed embodiment, calculating means concerned in the number of recovery processes is necessary, but the number of recovery processes after the exhaustion of the ink in the ink containing portion 16 is detected by the ink detecting means 3 is several times at greatest and therefore, even if the calculating means is not especially provided, for example, clogging is affected by the period for which the apparatus has been left without printing and therefore, whether the period for which the apparatus has been left without printing is e.g. one week or one month may be judged by a timer contained in the apparatus, and if said period is one week or longer, a preset value may only be added.

By this construction, the process in the calculation of the amount of used ink in the negative pressure generating member containing portion 14 can be simplified and the error in the calculation of the amount of used ink is small and therefore, the ink cartridge can be used until immediately before the ink therein becomes exhausted and thus, the waste of the ink can be made small.

(Fourth Embodiment)

Figure 4:
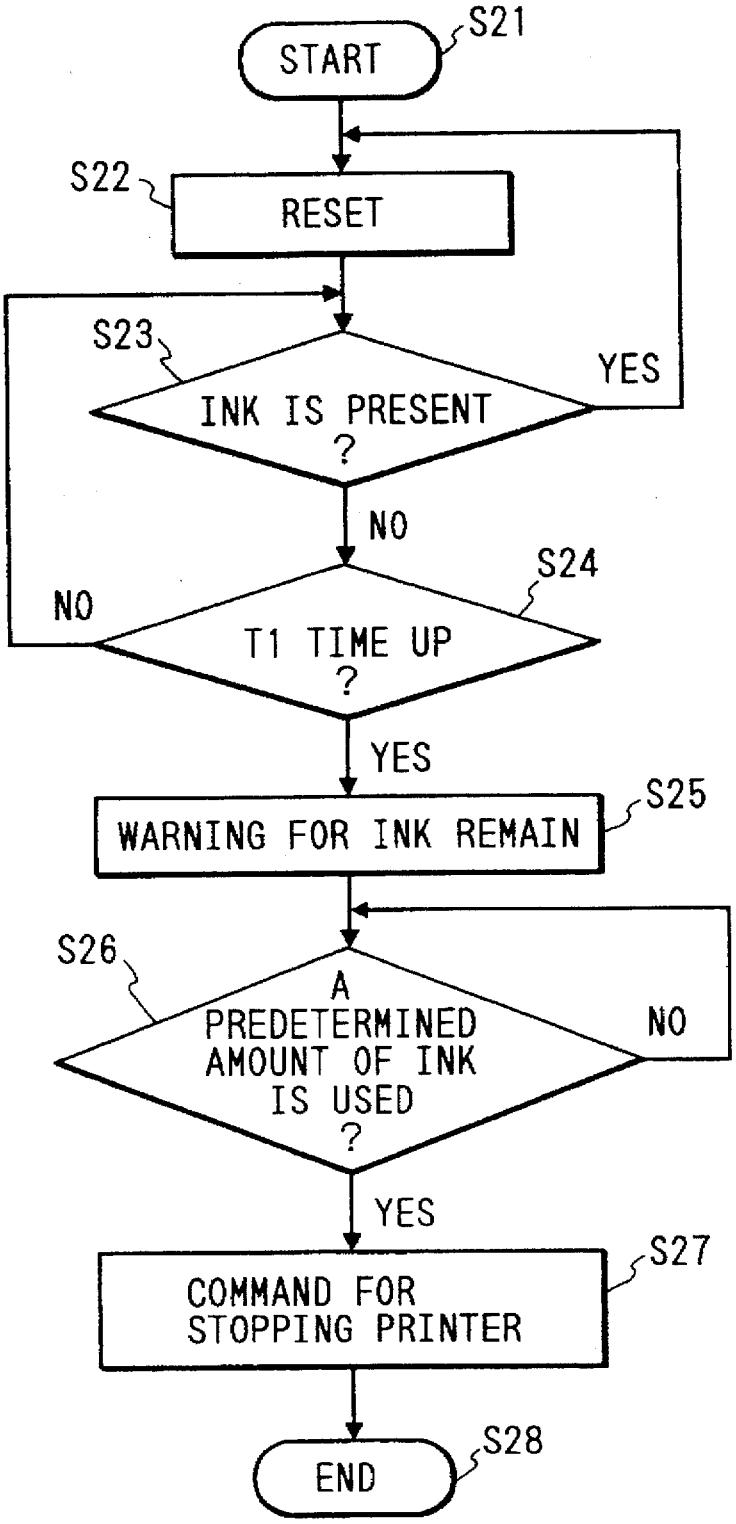

FIG. 4 is a flow chart showing the characteristic construction of a fourth embodiment of the present invention.

The fourth embodiment is characterized by the provision of a construction for warning the user of a reduction in ink remain at a step S25 after it is detected that in ink remain in the ink containing portion 16 shown in the first embodiment has been reduced (preferably has become exhausted).

When it is detected that the ink remain in the ink containing portion 16 has been reduced, the amount recordable with the remaining ink is limited and the user is warned of it (step S25), whereby the user can recognize the reduction in the amount of ink in the cartridge and can be prepared for providing a fresh ink cartridge.

Also, when a great amount of recording is to be effected, the user can interchange the ink cartridge in advance so that the supply of ink may not be interrupted in the course of recording, and the user's attention can be called to the interchanging process in conformity with the user's necessity.

Also, the warning in the present embodiment may be an aurally recognizable sound such as an alarm, or a visually recognizable alarm as by a lamp or indicating means.

(Fifth Embodiment)

Figure 5:
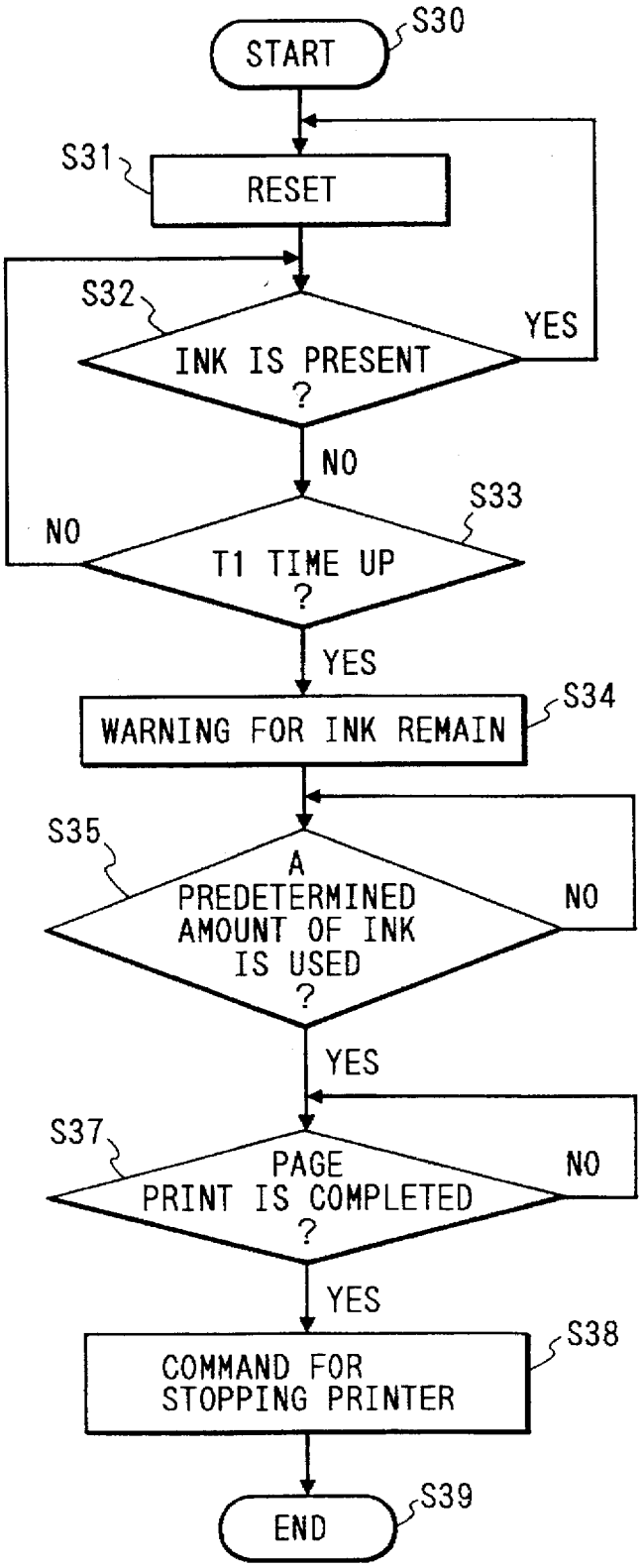

FIG. 5 is a flow chart for illustrating a fifth embodiment of the present invention.

In the aforedescribed first embodiment, design is made such that as shown at the step S16 of FIG. 3, the printer is stopped when the ink remain in the ink cartridge becomes a predetermined amount or less (preferably when the termination of the use of the ink cartridge is detected, with the detection level being defined as the time when the ink has become substantially exhausted).

However, the calculation for judging the amount of used ink at the step S15 is a calculation substantially effected during printing and therefore, when during printing, the ink reaches a predetermined amount of use, printing is stopped on the spot. It is not preferable that printing is suddenly stopped during printing.

For this reason, the present embodiment is characterized in that whether the printing of a page being printed has been completed is judged at a step S37 shown in FIG. 5, whereby the printer is stopped after the printing of the page being printed is completed. Design can be made such that setting is made so that an amount of ink capable of printing at least one page may remain in the negative pressure generating member containing portion 14 even after a reduction in the ink remain in the ink containing portion 16 is detected and thereafter a predetermined amount of ink is used, whereby the printer is not stopped during the printing of the page, but is stopped at a point of time whereat the printing of the page being printed has been completed.

A construction in which warning is effected at a point of time whereat a predetermined amount of ink has been used, and the remainder of the page being printed is printed, and a construction in which warning is effected at a point of time whereat the printer has been stopped are also preferably applied to the present embodiment.

(Sixth Embodiment)

Figure 6:
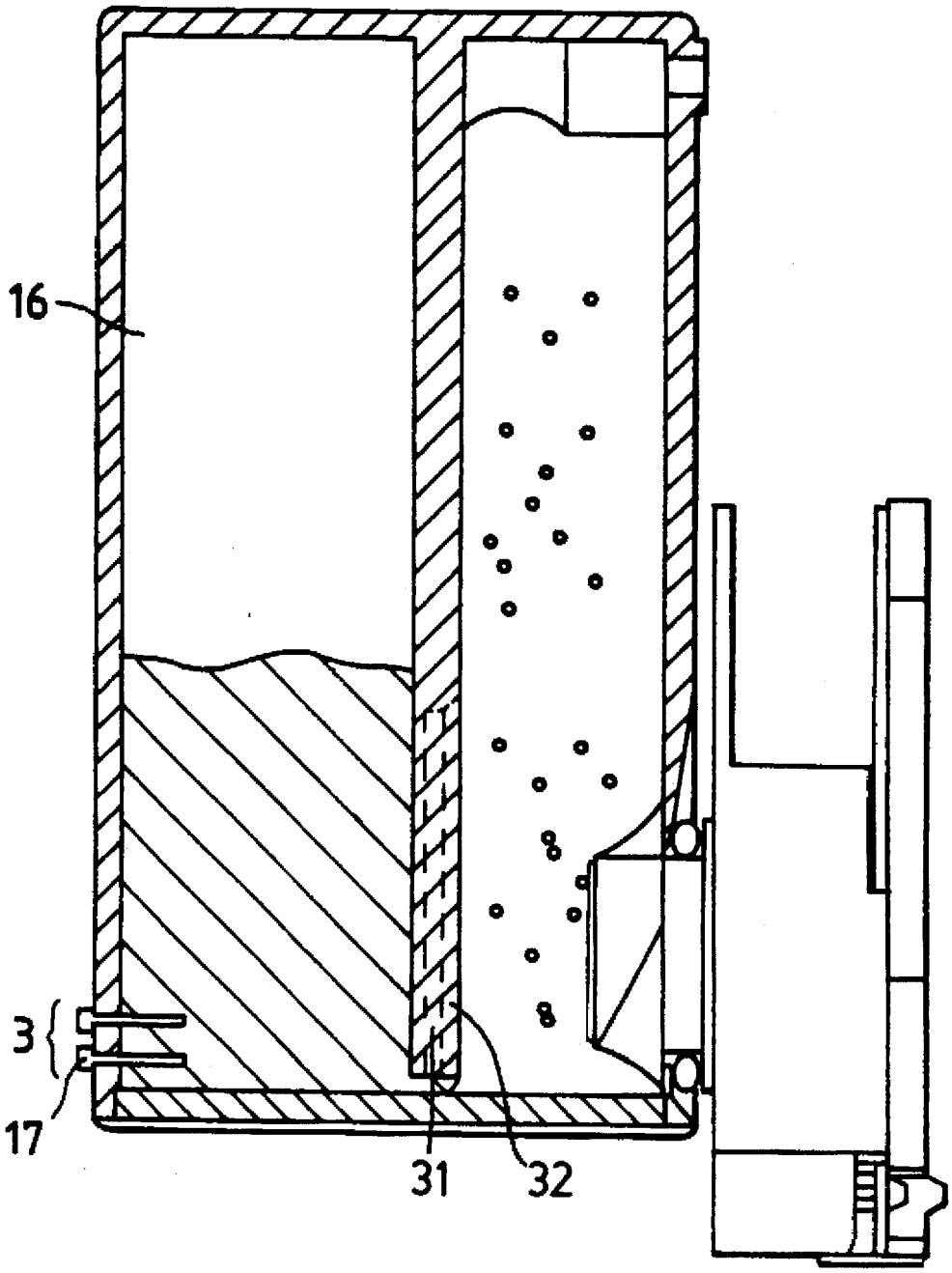
FIG. 6 shows a state in which an ink remain state detecting device according to the embodiment is assembled.

FIG. 6 is a schematic cross-sectional view of an ink cartridge for illustrating a sixth embodiment of the present invention.

In the first embodiment, there is adopted a construction in which the light emitting element 21 and light receiving element 22 are used as the means for detecting any reduction in the ink remain in the ink containing portion 16 and the optical interception by the ink is detected.

The present embodiment is characterized in that a pair of electrode members are provided as the means for detecting any reduction in the ink remain in the ink containing portion 16.

As shown in FIG. 6, a pair of electrode members 17 are provided near the bottom of the ink containing portion 16 so as to contact with the ink until the ink is almost used up. It is detected by the pair of electrode members 17 that the conduction between these electrode members 17 has become null, whereby a reduction in the ink remain in the ink containing portion 16 is detected.

In the present embodiment, it is not necessary to design the ink cartridge such that as in the first embodiment, the light projected by the light emitting element is transmitted to effect optical detection.

Also, each of the aforedescribed embodiment can be applied to the control after a reduction in the ink remain in the ink containing portion 16 is detected.

(Seventh Embodiment)

In the aforedescribed embodiments, as shown in FIGS. 3 and 5, the timer T1 or the calculation of the amount of used ink is reset each time it is detected that a predetermined or greater amount of ink remains in the ink containing portion 16.

However, in the above-described construction, when the ink cartridge 2 is removed and is again mounted with the ink in the ink containing portion 16 exhausted and with the ink remaining only in the negative pressure generating member containing portion 14, it is detected that the ink in the ink containing portion 16 has again become exhausted and thus, the calculation of the amount of used ink is started again, and there occurs an error to the calculation of the amount of used ink.

Figure 7:
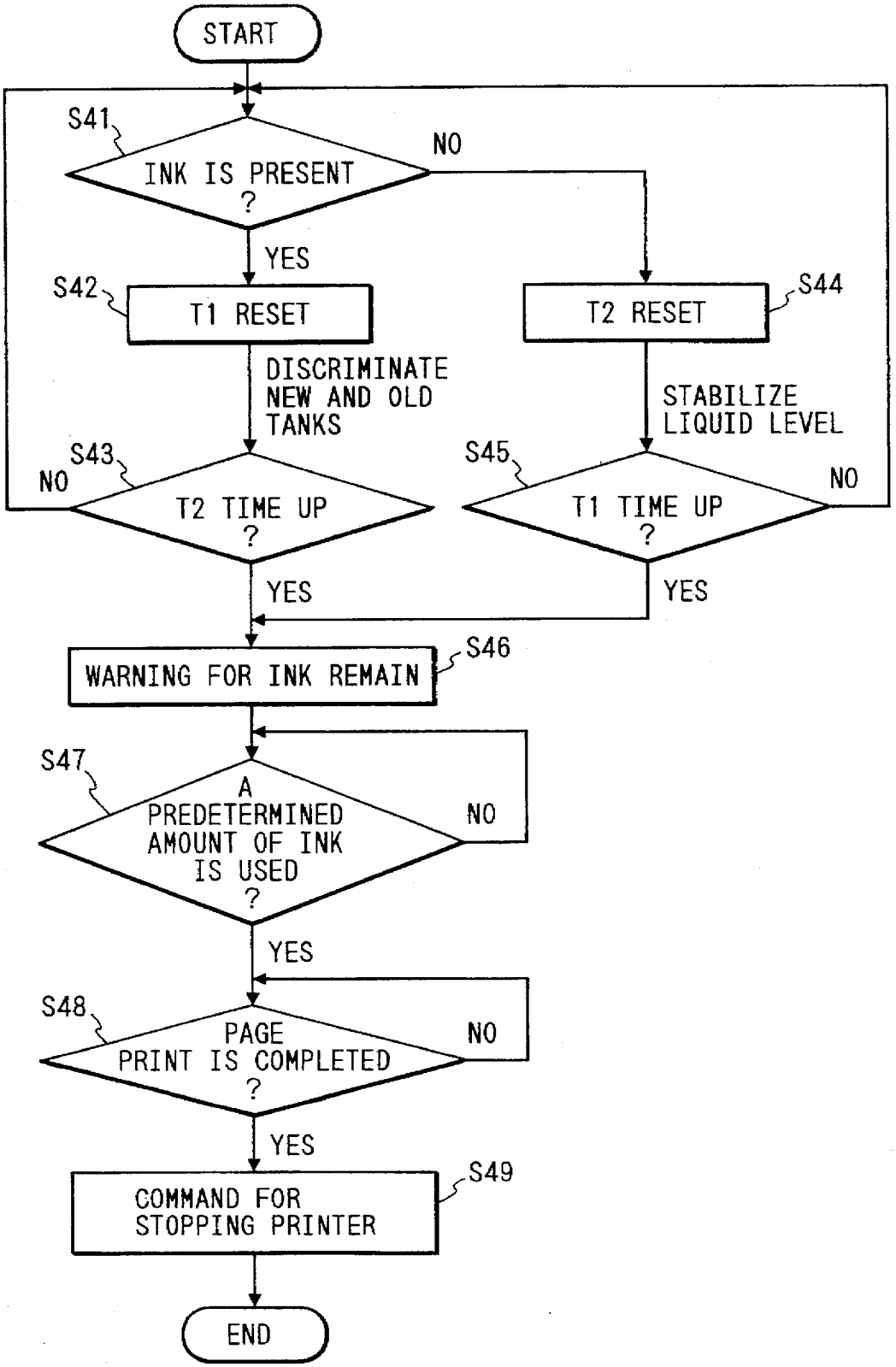

For this reason, in the present embodiment, as shown in FIG. 7, it is detected that a predetermined or greater amount of ink remains in the ink containing portion 16 shown in FIG. 1 (step S41), whereafter at a step S43, whether a fresh ink cartridge has been mounted or whether an ink cartridge used to some extent and having ink remaining only in the negative pressure generating member containing portion 14 has been mounted is judged. Specifically, by examining whether the set time T2 from after it is detected that the ink remains in the ink containing portion 16 until it is detected that the ink has become exhausted is up (step S43), whether the mounted ink cartridge is a fresh one can be judged. Accordingly, even when a cartridge with the ink remain in the ink containing portion 16 reduced is mounted again, the timer and the counter for calculating the amount of used ink are not reset, but the calculation of the amount of used ink can be continuedly executed and thus, the detection of accurate ink remain is possible.

The present invention brings about an excellent effect in recording apparatuses of the ink jet recording type, particularly a recording apparatus using a recording head of the ink jet type in which heat energy is utilized to form flying liquid drops to thereby effect recording.

As regards their typical construction and principles, apparatuses are preferable which effect recording by the use of the principles disclosed, for example, in U.S. Pat. No. 4,723,129 and U.S. Pat. No. 4,740,796. This system is applicable to both of the so-called on-demand type and continuous type, and particularly, in the case of the on-demand type, it is effective because at least one driving signal corresponding to recording information and providing a rapid temperature rise exceeding nuclear boiling is applied to an electro-thermal conversion element disposed correspondingly to a sheet or a liquid path in which liquid (ink) is retained, whereby heat energy is generated in the electro-thermal conversion element to create film boiling in the heat acting surface of a recording head, with a result that a bubble in the liquid (ink) corresponding at one to one to this driving signal can be formed. By the growth and contraction of this bubble, the liquid (ink) is discharged through a discharge opening to thereby form at least one drop. When this driving signal is made into a pulse shape, the growth and contraction of the bubble take place appropriately on the spot and therefore, the discharge of the liquid (ink) which is particularly excellent in responsiveness can be accomplished, and this is more preferable. This driving signal of a pulse shape may suitably be one as described in U.S. Pat. No. 4,463,359 or U.S. Pat. No. 4,345,262. The addition of the conditions described in U.S. Pat. No. 4,313,124 disclosing an invention relating to the temperature rise rate of said heat acting surface would enable more excellent recording to be accomplished.

As the construction of the recording head, besides a combined construction of a discharge port, a liquid path and an electro-thermal conversion element as disclosed in the above-mentioned patents (a straight liquid flow path or a right-angled liquid flow path), a construction using U.S. Pat. No. 4,558,333 and U.S. Pat. No. 4,459,600 which disclose a construction in which a heat acting portion is disposed in a bent area is also covered by the present invention. In addition, the present invention will also be effective if use is made of a construction based on Japanese Laid-Open Patent Application No. 59-123670 which discloses a construction in which a slit common to a plurality of electro-thermal conversion elements is the discharge portion of the electro-thermal conversion elements or Japanese Laid-Open Patent Application No. 59-138461 which discloses a construction in which an opening for absorbing the pressure wave of heat energy is made to correspond to the discharge portion. That is, according to the present invention, whatever may be the form of the recording head, recording can be effected reliably and efficiently.

Further, the present invention can also be effectively applied to a recording head of the full line type having a length corresponding to the maximum width of recording medium on which a recording apparatus can record. Such a recording head may be of any of a construction which satisfies the length by a combination of a plurality of recording heads and a construction as a single recording head formed as a unit.

In addition, the present invention is also effective when use is made of the recording head of the serial type as described above, or a recording head of the interchangeable chip type which can be electrically connected to an apparatus body or can be supplied with ink from the apparatus body by being mounted on the apparatus body, or a recording head of the cartridge type in which an ink tank is provided integrally with the recording head itself.

Also, the addition of discharge recovery means 102 for the recording head, preliminary auxiliary means, etc. as the construction of the recording apparatus of the present invention could more stabilize the effect of the present invention, and this is preferable. Specifically, as these means, mention may be made of capping means for the recording head, cleaning means, pressing or sucking means, preheating means for effecting heating by the use of an electro-thermal conversion element or a heating element discrete therefrom or a combination of these, and preliminary discharge means for effecting discharge discrete from recording.

Also, the kind or number of recording heads carried may be two or more correspondingly to a plurality of inks differing in recording color or density. That is, for example, the recording mode of the recording apparatus is not limited to the recording mode of only main color such as black, but the recording head may be constructed as a unit or may be provided by a combination of a plurality of heads, and the present is also very effective for an apparatus provided with at least one of the recording mode of different colors and the recording mode of full color by a mixture of colors.

Furthermore, in the above-described embodiments of the present invention, the ink has been described as liquid, but use may also be made of ink which solidifies at room temperature or below and softens or liquefies at room temperature, or since in the ink jet system, it is usual to control the temperature of ink itself within a range from 30° C. to 70° C. so that the viscosity of the ink may be within a stable discharge range, use may be made of ink which assumes liquid phase when a recording signal used is applied. In addition, ink which solidifies when left as it is and which liquefies by heating may be used to positively prevent the temperature rise by heat energy or prevent the evaporation of the ink by using such temperature rise as the energy for the stage change from the solid state to the liquid state of the ink. In any case, the present invention is also applicable to a case where use is made of ink having the nature that it is liquefied for the first time by the imparting of heat energy, such as ink which is liquefied by the imparting of heat energy conforming to a recording signal and is discharged as liquid phase ink, or ink which already begins to solidify at a point of time whereat it reaches a recording medium. The ink in such a case may assume a form which will be opposed to an electrothermal conversion element while being retained as liquid or solid in a recess or through-hole in a porous sheet, as described in Japanese Laid-Open Patent Application No. 54-56847 or Japanese Laid-Open Patent Application No. 60-71260. In the present invention, what is most effective for the above-described inks is what executes the above-described film boiling.

In addition, the form of the ink jet recording apparatus of the present invention may be, besides one used as the image output terminal of an information processing instrument such as a computer, the form of a copying apparatus combined with a reader or the like, or the form of a facsimile apparatus having the signal transmitting and receiving function.

As described above in detail, in the detection of the remain state in an ink cartridge having a plurality of ink containing chambers differing in the ink containing state from each other and communicated with each other by a gap portion, the remain state is first detected by a remain detecting method suitable for the ink containing state of the ink containing chamber in which ink is consumed earlier, and when the ink in said ink containing chamber is consumed, the remain state in the ink cartridge is detected by a remain detecting method suitable for the ink containing chamber in which ink is consumed lastly.

More particularly, in the ink containing chamber in which ink remains lastly, there is contained a negative pressure generating member for supplying the ink to the head. Accordingly, the remain state of the ink can be accurately detected by calculating the amount of ink used from the ink cartridge.

With such construction, even when a cartridge comprising a plurality of ink containing chambers is used, the ink cartridge can be used until immediately before the ink becomes exhausted, and the accurate remain state of the ink can be detected and therefore, it will never happen that the recording operation is performed by mistake with the ink exhausted and the head is damaged.

Also, a warning operation is performed to the user at a point of time whereat the ink in the first-mentioned ink containing chamber has become exhausted, whereby the user can be informed in advance of the fact that the remain of the ink has become small, and the user's attention can be called to the interchange of the ink cartridge before the ink therein becomes exhausted.

Also, recording is not stopped during recording, but recording is stopped at a point of time whereat the recording on a page being printed has been completed, whereby the waste of the recording paper being printed can be prevented.

Also, when an ink cartridge used to some extent is once removed and is again mounted by the user, whether the ink cartridge is one in which the remain of the ink in the earlier consumed ink containing chamber has already become null is judged, whereby the count value or the like for effecting the calculation of the amount of used ink can be controlled by the resetting operation and thus, a wrong detecting operation can be prevented.

What is claimed is:

1. An ink jet recording apparatus provided with an ink containing member having a plurality of ink containing portions differing in ink containing state from each other and communicated with each other by a gap portion, and an ink jet head for discharging ink supplied by being communicated with one end of said plurality of ink containing portion, said apparatus comprising:

first detecting means for detecting an ink remain in one of said plurality of ink containing portions other than the ink containing portion for supplying the ink to said ink jet head and for detecting any reduction in the ink remain in said one ink containing portion;

second detecting means for detecting an ink remain in said ink containing member and for detecting the reduced state of the ink remain in the ink containing portion communicating with said ink jet head; and control means for starting the detection by said second detecting means when said first detecting means detects that the remain of the ink has become smaller than a predetermined amount.

2. A method of detecting an ink remain of an ink containing member in an ink jet recording apparatus provided with an ink containing member having a plurality of ink containing portions differing in ink containing state from each other and communicated with each other by a gap portion, and an ink jet head for discharging ink supplied by being communicated with one end of said plurality of ink containing portions, said method comprising the steps of:

detecting a first ink remain in one of said plurality of ink containing portions other than the ink containing portion for supplying the ink to said ink jet head and detecting any reduction in the ink remain in said one ink containing portion; and detecting a second ink remain in the ink containing member and detecting the reduced remain of the ink in the ink containing portion communicating with said ink jet head when said step of detecting the first ink remain detects that the remain of the ink has become smaller than a predetermined amount.

3. An ink jet recording apparatus provided with an ink jet head for discharging ink, and an ink cartridge for supplying the ink to said ink jet head, said ink cartridge having a first ink containing chamber containing a negative pressure generating member therein and provided with a communicating portion for supplying the ink to said ink jet head, and a second ink containing chamber directly containing therein the ink to be supplied to said first ink containing chamber, said apparatus comprising:

first detecting means for detecting the remain of the ink in said second ink containing chamber;

used ink amount calculating means for calculating the amount of ink used from said ink cartridge; and control means for starting the calculation by said used ink amount calculating means when said first detecting means detects that the remain of the ink in said second ink containing chamber has become smaller than a predetermined amount.

4. An ink jet recording apparatus according to claim 3, wherein said used ink amount calculating means calculates the amount of used ink by the number of ink drops discharged from said ink jet head.

5. An ink jet recording apparatus according to claim 3, further comprising recovery means for recovering an ink discharging state of said ink jet head and wherein said used ink amount calculating means calculates the amount of used ink by the amount of ink discharged from said ink jet head and the amount of ink used by said recovery means.

6. An ink jet recording apparatus according to claim 5, wherein said recovery means causes the ink to be discharged from said ink jet head to thereby recover the ink discharging state.

7. An ink jet recording apparatus according to claim 5, wherein said recovery means further comprises means for sucking and discharging the ink from said ink jet head to thereby recover the ink discharging state.

8. An ink jet recording apparatus according to claim 5, wherein said recovery means further comprises means for pressing and discharging the ink from said ink jet head to thereby recover the ink discharging state.

9. An ink jet recording apparatus according to claim 3, further comprising stopping means for stopping the recording by said ink jet recording apparatus when the amount of used ink calculated by said used ink amount calculating means reaches a predetermined amount.

10. An ink jet recording apparatus according to claim 3, further comprising stopping means for stopping the recording by said ink jet recording apparatus and wherein said control means effects the recording of a page during said recording when the amount of used ink calculated by said used ink amount calculating means reaches a predetermined amount, whereafter said control means stops the recording by said stopping means.

11. An ink jet recording apparatus according to claim 3, further comprising warning means for warning a user of a reduction in ink remain.

12. An ink jet recording apparatus according to claim 11, wherein said control means controls said warning means to warn the user when said first detecting means detects that the remain of the ink in said second ink containing chamber has become smaller than a predetermined amount.

13. An ink jet recording apparatus according to claim 3, wherein said ink cartridge is removably mounted on said ink jet recording apparatus.

14. An ink jet recording apparatus according to claim 13, wherein said first detecting means detects whether the remain of the ink in said second ink containing chamber is smaller than a predetermined amount to thereby detect an ink remain status of said ink cartridge.

15. An ink jet recording apparatus according to claim 3, wherein said ink cartridge is constructed integrally with said ink jet head and is removably mounted on said ink jet recording apparatus.

16. An ink jet recording apparatus according to claim 15, wherein said first detecting means detects whether the remain of the ink in said second ink containing chamber is smaller than a predetermined amount to thereby detect an ink remain status of said ink cartridge.

17. An ink jet recording apparatus according to claim 3, wherein said ink jet head is provided with heat energy generating means for giving heat energy to the ink, and creates a state change by heating the ink by said heat energy to thereby discharge the ink.

18. An ink remain detecting device for an ink jet recording apparatus provided with an ink jet head for discharging ink and an ink cartridge for supplying the ink to the ink jet head, said ink cartridge having a first ink containing chamber containing a negative pressure generating portion therein and provided with a communicating portion for supplying the ink to the ink jet head and a second ink containing chamber directly containing therein the ink to be supplied to said first ink containing chamber, said ink remain detecting device comprising:

first detecting means for detecting a remain of the ink in said second ink containing chamber;

used ink amount calculating means for calculating the amount of ink used from said ink cartridge; and control means for starting the calculation by said used ink amount calculating means when said first detecting means detects that the remain of the ink in said second ink containing chamber has become smaller than a predetermined amount.

19. An ink remain detecting method for use in an ink jet recording apparatus provided with an ink jet head for discharging ink and an ink cartridge for supplying the ink to the ink jet head, said ink cartridge having a first ink containing chamber containing a negative pressure generating member therein and provided with a communicating portion for supplying the ink to said ink jet head and a second ink containing chamber directly containing therein the ink to be supplied to said first ink containing chamber, said method comprising the steps of:

detecting the remain of the ink in said second ink containing chamber; and calculating the amount of ink used from said ink cartridge when said detecting step detects that the remain of the ink in said second ink containing chamber has become smaller than a predetermined amount.

20. An ink remain detecting method according to claim 19, wherein said used ink amount calculating step calculates the amount of used ink according to a number of ink drops discharged from said ink jet head.

21. An ink remain detecting method according to claim 19, further comprising a step of recovering an ink discharging state of said ink jet head, and wherein said used ink amount calculating step calculates the amount of used ink by the amount of ink discharged from said ink jet head and the amount of ink used in said recovering step.

22. An ink remain detecting method according to claim 21, wherein said recovering step further comprises causing the ink to be discharged from said ink jet head to thereby recover the ink discharging state.

23. An ink remain detecting method according to claim 21, wherein said recovering step further comprises sucking and discharging the ink from said ink jet head to thereby recover the ink discharging state.

24. An ink remain detecting method according to claim 21, wherein said recovering step further comprises pressing and discharging the ink from said ink jet head to thereby recover the ink discharging state.

25. An ink remain detecting method according to claim 19, further comprising a step of stopping recording when the amount of used ink calculated by said used ink amount calculating step reaches a predetermined amount.

26. An ink remain detecting method according to claim 19, further comprising a step of effecting the recording of a page when during said recording the amount of used ink calculated by said used ink amount calculating step reaches a predetermined amount, and a step of thereafter stopping the recording.

27. An ink remain detecting method according to claim 19, further comprising a step of warning a user when it is detected in said detecting step that the remain of the ink in said second ink containing chamber has become smaller than a predetermined amount.

28. An ink remain detecting method according to claim 19, wherein said ink cartridge is removably mounted on said ink jet recording apparatus.

29. An ink remain detecting method according to claim 28, wherein said detecting step detects whether the remain of the ink in said second ink containing chamber is smaller than a predetermined amount, thereby detecting an ink remain status of said ink cartridge.

30. An ink remain detecting method according to claim 19, wherein said ink cartridge is constructed integrally with said ink jet head and is removably mounted on said ink jet recording apparatus.

31. An ink remain detecting method according to claim 30, wherein said detecting step detects whether the remain of the ink in said second ink containing chamber is smaller than a predetermined amount, thereby detecting an ink remain status of said ink cartridge.

32. An ink remain detecting method according to claim 19, wherein said ink jet head gives heat energy to the ink and creates a state change by heating the ink by said heat energy to thereby discharge the ink.

* * * * *